US005881839A

United States Patent [19]

Stanley

[11] Patent Number: 5,881,839

[45] Date of Patent: Mar. 16, 1999

[54] MOBILE HUNTER'S STAND

[75] Inventor: Cecil A. Stanley, Starke, Fla.

[73] Assignee: Eagle Ventures, Ocala, Fla.

[21] Appl. No.: 938,554

[22] Filed: Sep. 26, 1997

[51] Int. Cl.[6] ..... E06C 7/16

[52] U.S. Cl. ..... 182/116; 182/115; 182/127

[58] Field of Search ..... 182/106, 115, 182/116, 127, 187, 152, 180.1–180.3

[56] References Cited

U.S. PATENT DOCUMENTS

| | | | |
|---|---|---|---|
| 3,150,743 | 9/1964 | Kirchhoefer | 182/115 |
| 4,690,248 | 9/1987 | Killeen | 182/127 |
| 4,800,986 | 1/1989 | Hayes | 182/116 |
| 4,923,050 | 5/1990 | Vitols | 182/127 |
| 5,143,177 | 9/1992 | Smith | 182/187 |
| 5,469,933 | 11/1995 | Thomason | 182/127 |
| 5,653,309 | 8/1997 | Sturm | 182/187 |

*Primary Examiner*—Daniel P. Stodola
*Assistant Examiner*—Hugh B. Thompson

[57] ABSTRACT

A hunter's stand which may be easily secured to the bed of a pick up truck. In the collapsed position, the stand is lower than the cab of the truck and may be readily driven to any desired destination at highway speeds. Upon arrival at the hunting area the truck may be driven off road to the desired position. The hunter's stand may be erected by one person and is immediately ready for use. It is a simple matter for one person to collapse the stand for transportation to a different hunting site or to drive to overnight accommodations. At the end of the hunting season, the collapsed hunter's stand may be quickly and easily removed from the pick up truck and stored in a small space until further needed.

9 Claims, 10 Drawing Sheets

MOBILE HUNTER'S STAND

FIELD OF THE INVENTION

The present invention relates generally to removable accessory structures for motorized land vehicles and more specifically to a folding hunter's stand which is temporarily installable on and removable from a pick up truck. The device is of particular value for hunting.

1. Background of the Invention

The present invention pertains to a portable hunter's stand which may be easily installed on a pick up truck, transferred to any hunting location that is accessible to the truck and erected by one person, i.e., the driver. The hunter's stand in it's upright position provides a platform about 14 feet above the ground which may support a chair that can provide the hunter with a 360 degree view at that elevation.

A surprising number of hunting enthusiasts spend large amounts of their free time during the hunting season in pursuit of their interest. It is not unusual for hunters to travel long distances to a location that is noted for favorable hunting conditions.

Trade shows for the outdoorsman and advertisements in hunting and outdoors magazines are replete with all types of sporting equipment, guns, ammunition, archery equipment, loading presses for those hunter's who load their own ammunition, targets to sight in a gun, and portable platforms which may be attached to the trunk of a tree. The hunter may sit or crouch on such elevated platforms to await or spot game in a wooded area.

It is well known that it is desirable to hunt certain game from an elevated position above the forest or woodland floor. The elevated position provides an improved view for spotting approaching target game. Also some species of game are more alert to danger at ground level and are less likely to observe an elevated hunter.

A familiar hunters platform is the ladder stand which incorporates a ladder to provide support for the platform as it rests against a tree. Securing means is provided for the platform to secure it to the tree and the ladder provides support for and access to the platform.

A need arises for a temporarily installable and removable hunter's stand for a pick up truck which, when collapsed, may be transported to the hunting site at maximum speed and erected when the truck is in the desired position.

2. Description of the Prior Art

Ladder stands such as those described in U.S. Pat. Nos. 4,905,792, 5,009,283, and 5,106,732 are, relatively easy to install but limit the height to which the individual can reach in the tree. Another drawback of these types of stands is that they are susceptible to theft or use by others and must be taken out of the field for these problems to be avoided.

U.S. Pat. No. 5,538,101 issued to James J. Kempf on Jul. 23, 1996 describes a ladder stand that permits the hunter to remove the ladder from the platform while having the platform secured to the tree.

U.S. Pat. No. 5,492,196 issued to John Michno on Feb. 20, 1996 describes a portable deer cart and tree stand. The structure described has utility both as a tree stand and a game cart.

U.S. Pat. No. 5,439,072 issued to Joseph R. Jenkins, Jr. on Aug. 8, 1995 describes a light weight portable modular ladder system that is less cumbersome to carry through dense woods. This ladder system may be adjusted in length and is highly adaptable to the existing tree structure thereby providing the hunters with a more comfortable and stable climb when they are climbing the tree to set up a tree stand.

U.S. Pat. No. 5,297,844 issued to Herbert H. Houstein on Mar. 29, 1994 relates to a cab structure that may be installed on all terrain vehicles, (hereinafter referred to as "ATVs"). The cab is designed primarily for the comfort and convenience of the occupant who may remain within the cab for weather protection. A hunting stand is mounted on the roof of the cab and may be folded to a position at the back of the cab when the ATV is moved.

It is a disadvantage of the hunter's stand taught by Houstein that the height of the platform is severely limited this eliminating the advantages of tree stands which are placed at much higher elevations.

Another serious disadvantage of the hunter's stand illustrated by U.S. Pat. No. 5,297,844 is the limited mobility of an ATV. Such vehicles are designed and engineered to provide maximum access to off the road locations and have limited utility if one wishes to travel several hundred miles to hunt.

Still another drawback is the short wheel base of the ATV. Although Houstein has attempted to compensate for this factor by the use of lateral bracing, the elevation of the platform remains restricted. Moreover, any attempt to increase the height of the platform would not be safe.

None of the above noted patents, taken either singularly or in combination, are seen to disclose the specific arrangement of concepts disclosed by the present invention.

BRIEF SUMMARY OF THE INVENTION

The present invention relates to an improved hunter's stand installable on a pick up truck.

Accordingly, one of the objects of the present invention is to provide an improved hunter's stand structure which is temporarily installable on and easily removable from a pick up truck.

Another object of the present invention is to provide a hunter's stand installable on a pick up truck which, when collapsed, is within the bed of the truck and below the top of the cab of the pick up truck.

A further object of the present invention is to provide a hunter's stand installable on a pick up truck which, when erected, will support and provide access to a platform no less than 9 feet above the bed of the truck.

Yet another object of the present invention is to provide a hunter's stand installable on a pick up truck which, in the collapsed position, may be transported at maximum highway speed to a hunting area many miles distant.

Still another object of the present invention is to provide a hunter's stand installable on a pick up truck which, in the collapsed position may be conveniently transported off road to the place of use and erected to its upright position by one person.

An additional object of the present invention is to provide a hunter's stand that can be collapsed to it's lower position by one person whereby the pickup truck and stand may be driven to overnight accommodations.

Another object of the invention is to provide a hunters stand with a platform that supports a chair for the hunter's convenience. When the hunter's stand is collapsed, the chair is positioned beneath the platform and within the bed of the truck.

Yet another object of the present invention is to provide a hunter's stand which may be conveniently shipped to the customer in an 8 foot by four foot by one foot box, assembled by the customer and stored in a small space until needed for use.

A final object of the invention is to provide an improved hunter's stand for the purposes described which is inexpensive, dependable and fully effective in accomplishing it's intended purposes.

With this and further objects in view, which will more readily appear as the nature of the invention is better understood, the invention consists in the novel combination and arrangement of parts hereinafter more fully described, illustrated and claimed with reference being made to the attached drawings.

DETAILED DESCRIPTION OF THE PREFERRED EMBODIMENT

Figure 1:
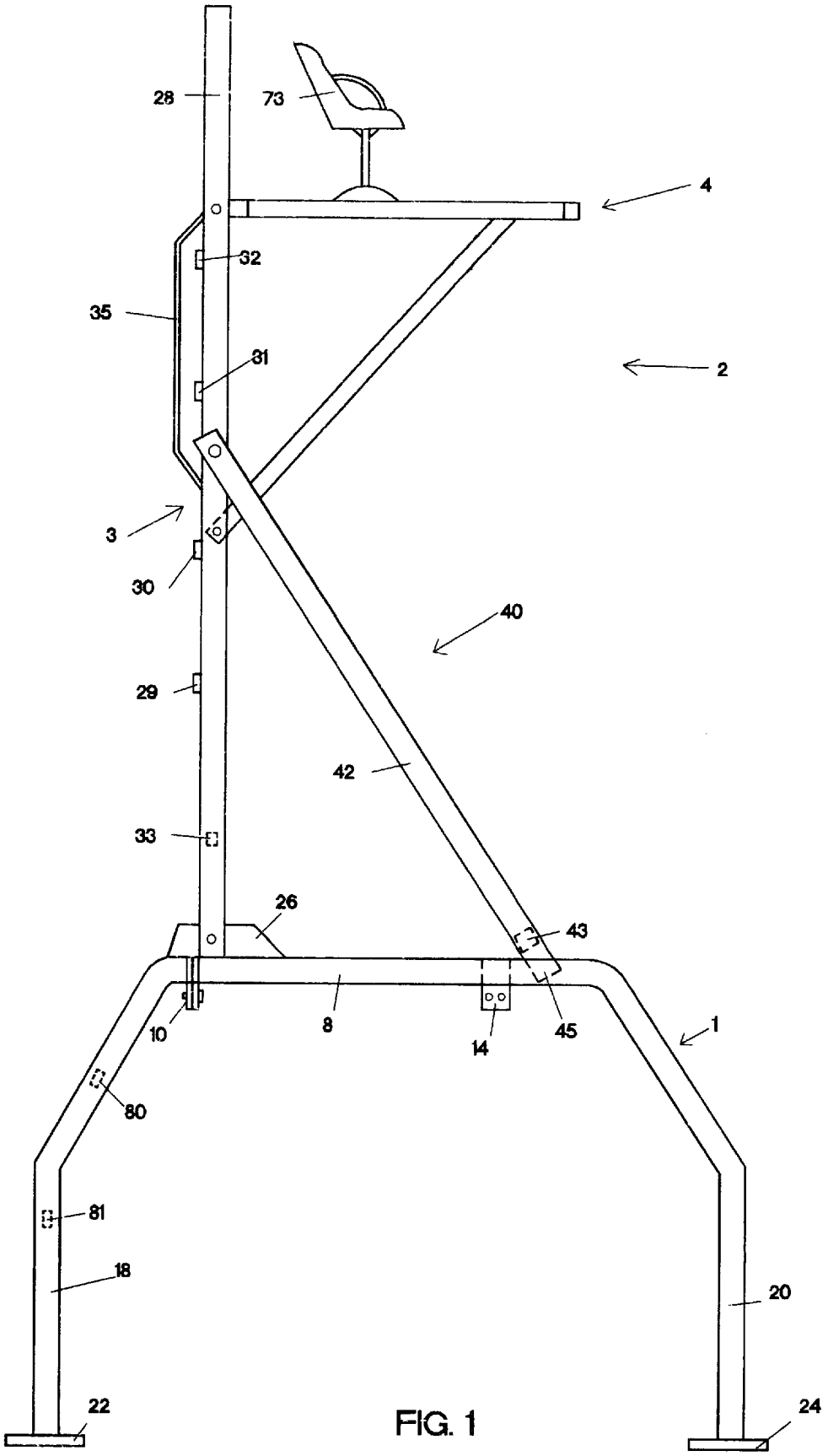
FIG. 1 is a side plan view of the hunter's stand of the present invention, with the upper portion of the stand erected.
Figure 2:
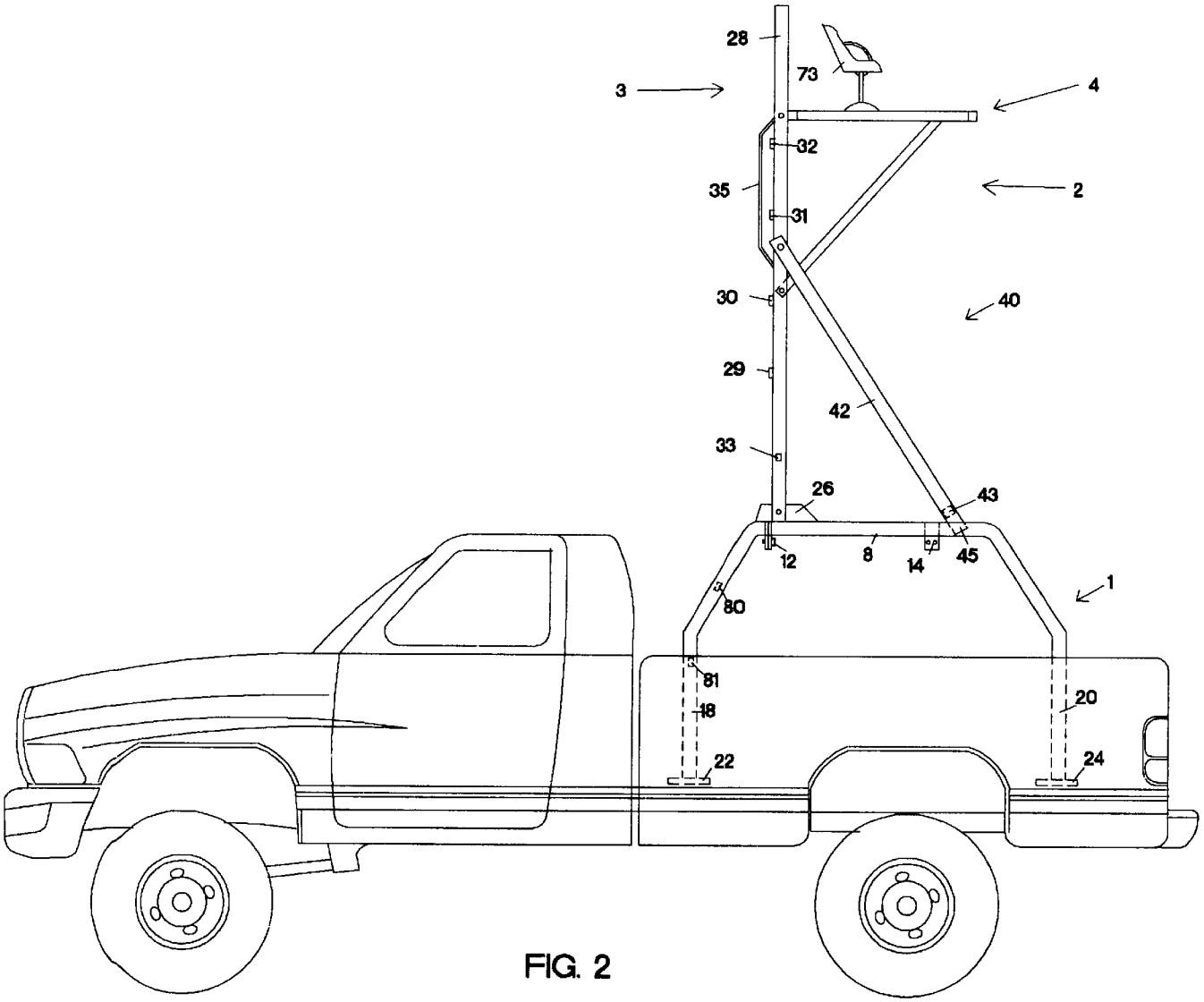
FIG. 2 is a side plan view of the hunter's stand of FIG. 1 mounted on a pick up truck.
Figure 3:
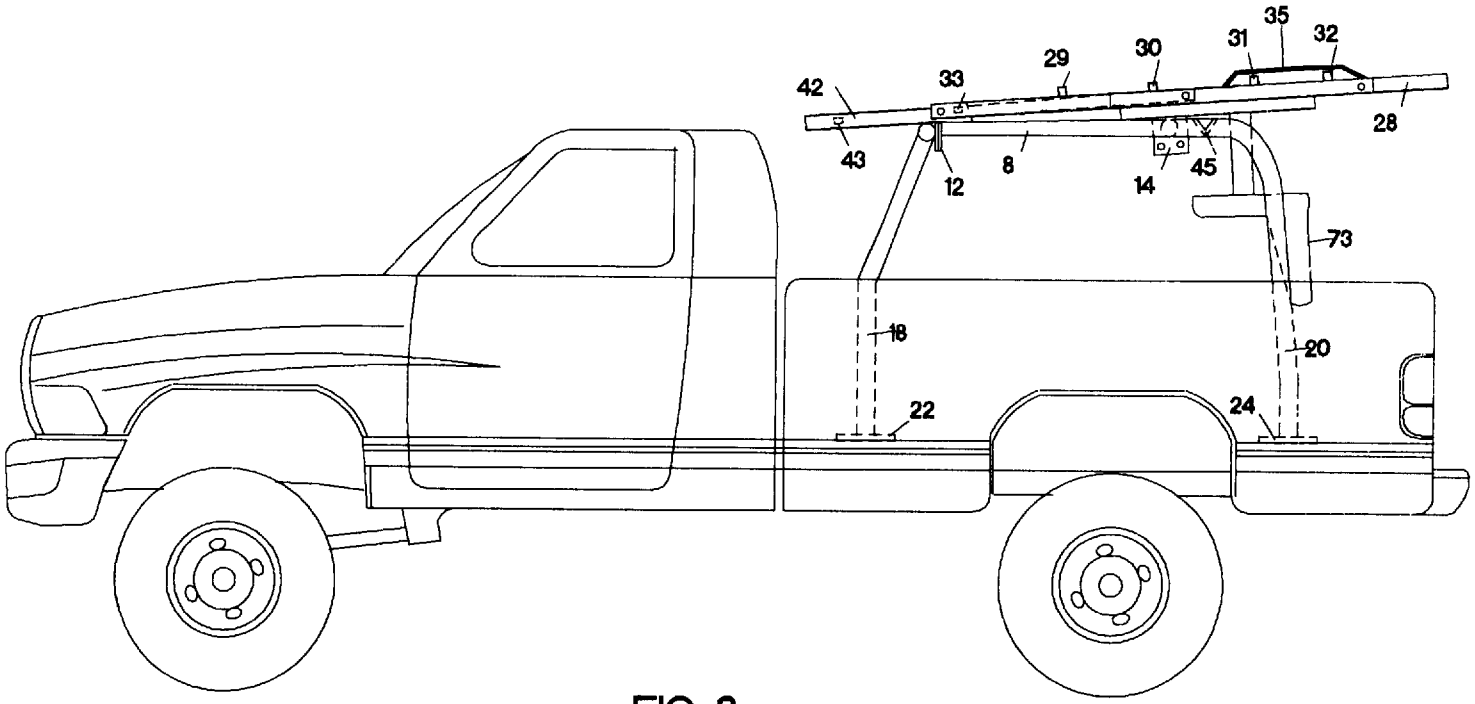
FIG. 3 is a side plan view of the hunter's stand of FIG. 1 with the upper portion of the hunter's stand in the collapsed position, mounted on a pick up truck.

Referring now to FIG. 1 and FIG. 2 of the drawings, The present invention will be seen to relate to a temporarily installable and removable base 1 and upper stand structure 2 for temporary installation on a pick up truck as shown in FIG. 2 and FIG. 3. The upper stand structure 2 comprises a ladder 3 and a platform 4.

Figure 4:
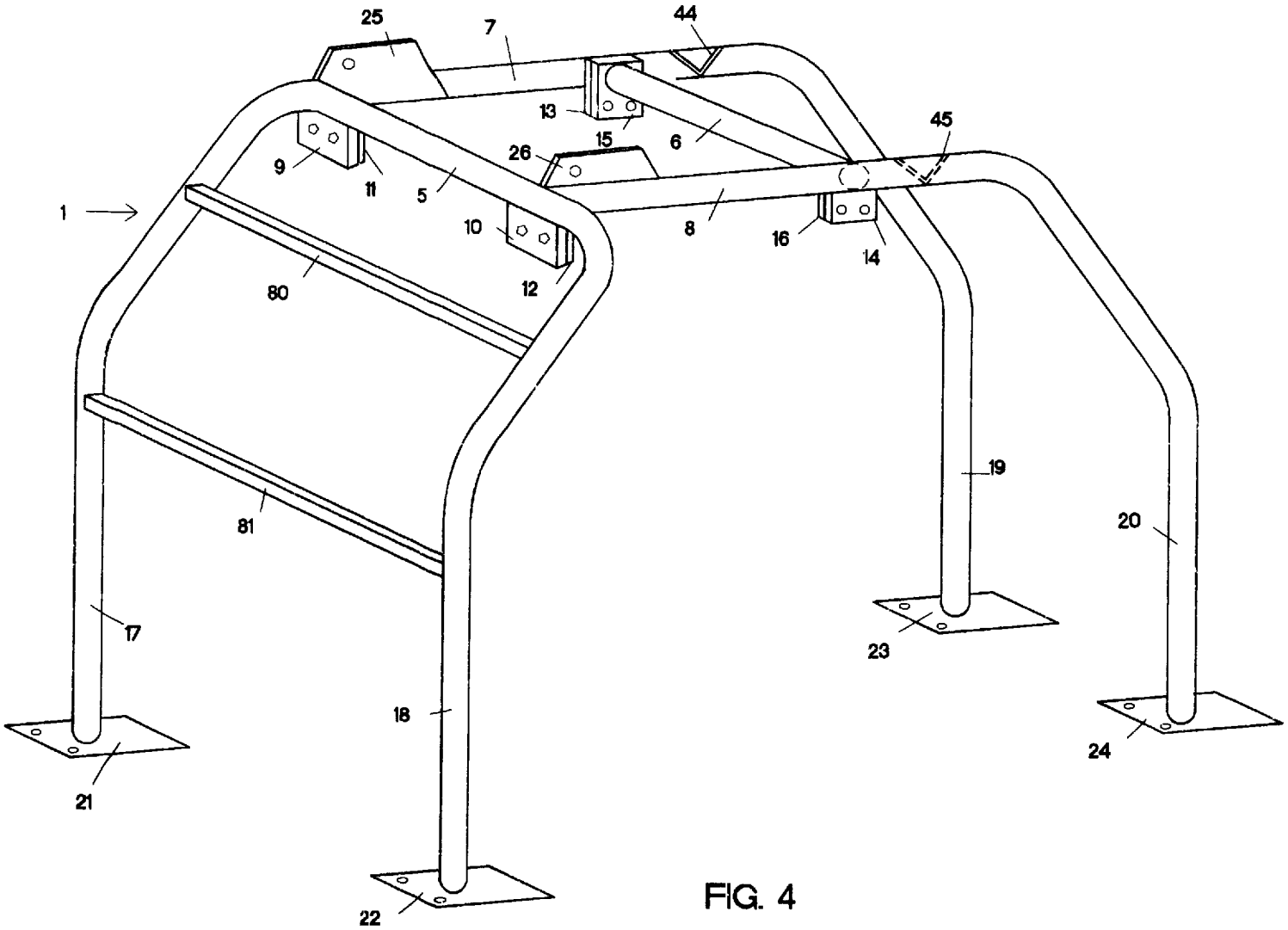
FIG. 4 is a perspective view of the oblong base of the hunter's stand illustrated in FIG. 1, showing means for mounting the ladder section on said base and means for mounting the base on a truck.

As best illustrated in FIG. 4, the base is preferably assembled from round section two inch 16 gauge steel tube for strength and relatively good strength to weight ratio (although other materials and assembly means may be used) and includes a front member 5, a rear member 6 and parallel side members 7 and 8. Plates 9 and 10 welded to the front member 5 and plates 11 and 12 welded to side members 7 and 8 are bolted together. Also plates 13 and 14 welded to side members 7 and 8 and plates 15 and 16 welded to the rear member 6 are bolted together to form an oblong base.

The front legs 17 and 18 are integral with the front member 5 and are reinforced by the tubes 80 and 81. The rear legs 19 and 20 are integral with the side members 7 and 8. Foot plates 21 and 22 re welded to the bottom of the front legs 17 and 18. Foot plates 23 and 24 are welded to the bottom of the rear legs 19 and 20 as shown. Axle plates 25 and 26 are welded to the forward section of side members 7 and 8.

Figure 5:
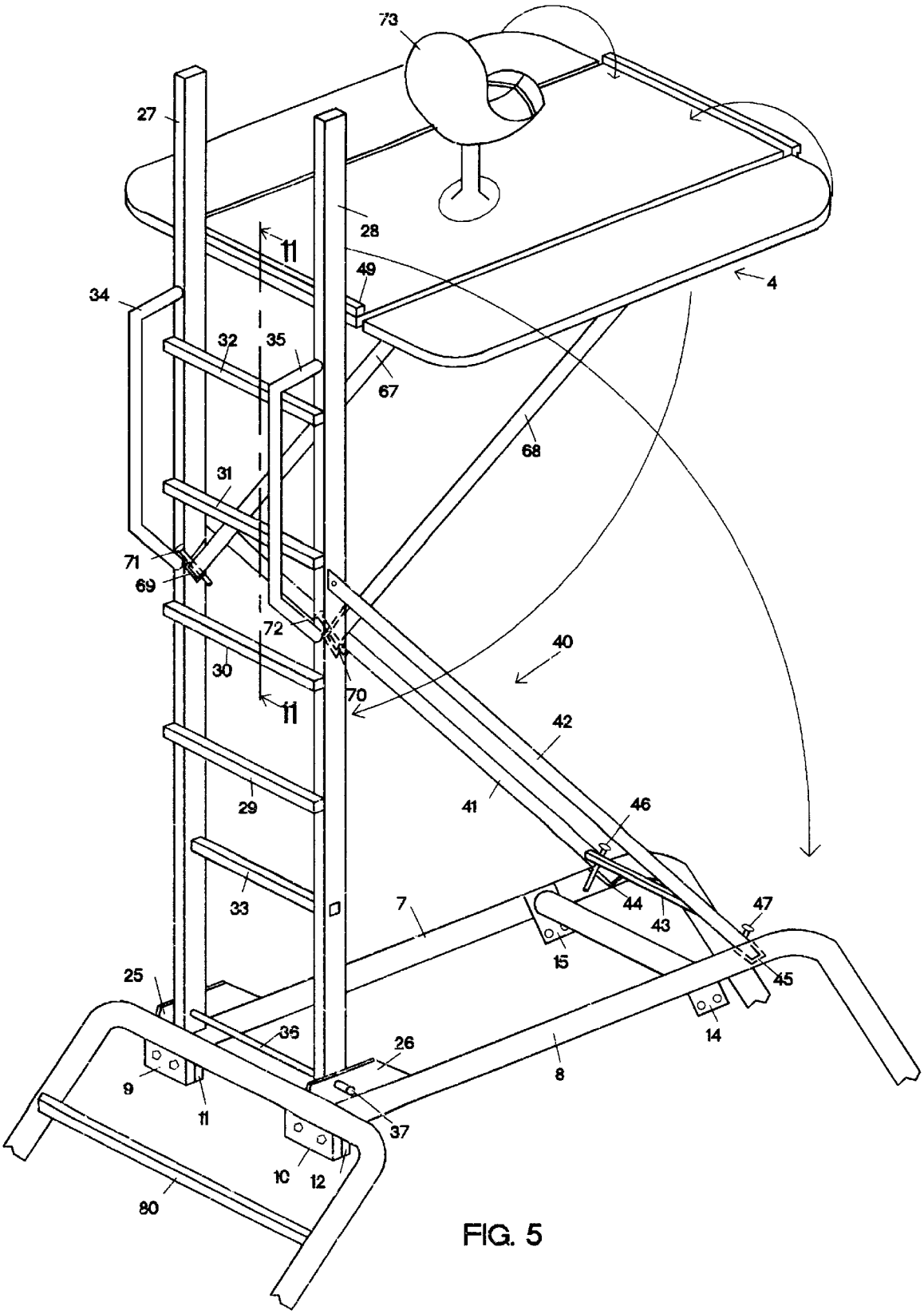
FIG. 5 is a broken perspective view of the hunter's stand of the present invention with the upper portion of the hunter's stand erected.

With reference to FIG. 1 and FIG. 5 the legs 27 and 28 of the ladder are preferably assembled from 1×2 inch steel tubing and the rungs 29, 30, 31 and 32 are preferably 1×1 inch steel tubing. Again, alternate construction may be used if desired. The bottom of the ladder is reinforced by a brace 33. Hand rails 34 and 35 are welded to the legs 27 and 28 and assist the hunter in ascending the ladder.

Figure 10:
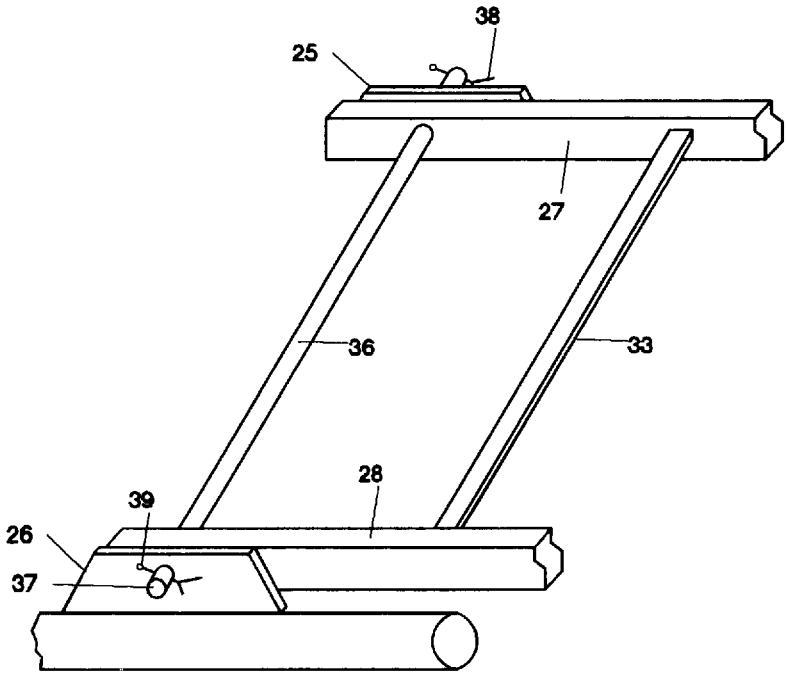
FIG. 10 is an enlarged broken perspective view of a portion of the hunter's stand illustrated in FIG. 1 and shows one method of securing the lower end of the ladder to the oblong base of the hunter's stand.
Figure 14:
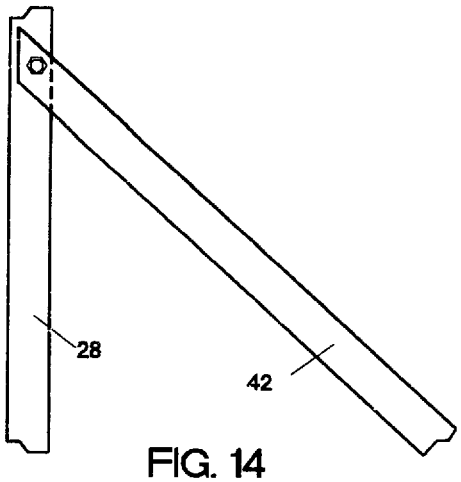
FIG. 14 is a broken enlarged side elevation of the ladder and ladder brace showing one of the bolts that secures the ladder brace to the ladder for rotation.
Figure 15:
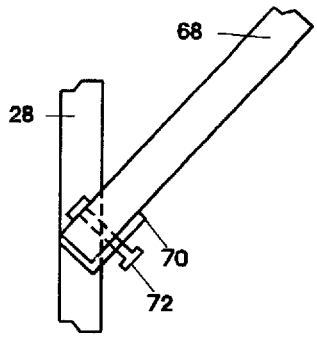
FIG. 15 is a broken enlarged view of the platform brace illustrated in FIG. 5.

As best shown in FIG. 10, a length of steel tubing 36 extends through legs 27 and 28 of the ladder and receives an axle 37 which passes through the axle plates 25 and 26. The axle 37 is maintained in the position shown by cotter keys 38 and 39 that pass through the ends of the axle.

Figure 12:
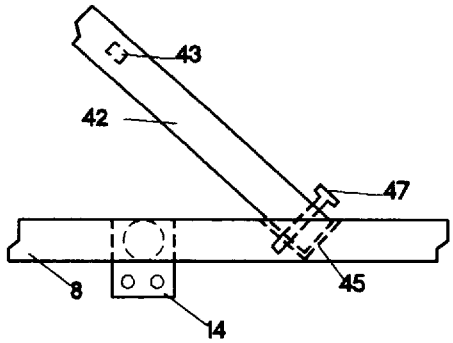
FIG. 12 is a broken enlarged side elevation showing one method of securing the lower end of the ladder brace to the oblong base of the hunter's stand.

The ladder may be erected to the position shown in FIG. 1 and FIG. 5 by rotating the ladder on it's axle 37 to the upright position and may be supported in that position by the ladder brace 40 which is constructed with two parallel legs 41 and 42, mounted for rotation on the outside of the ladder legs 27 and 28 with 3/8 inch bolts. The ladder brace is reinforced near the bottom end by a 1×1 inch steel tube 43 as illustrated in FIG. 5 and FIG. 12. The bottom end of the ladder brace is received by two right angle brackets 44 and 45 welded to the inside of the side rails 7 and 8 and held in that position by the quick release pins 46 and 47.

Figure 8:
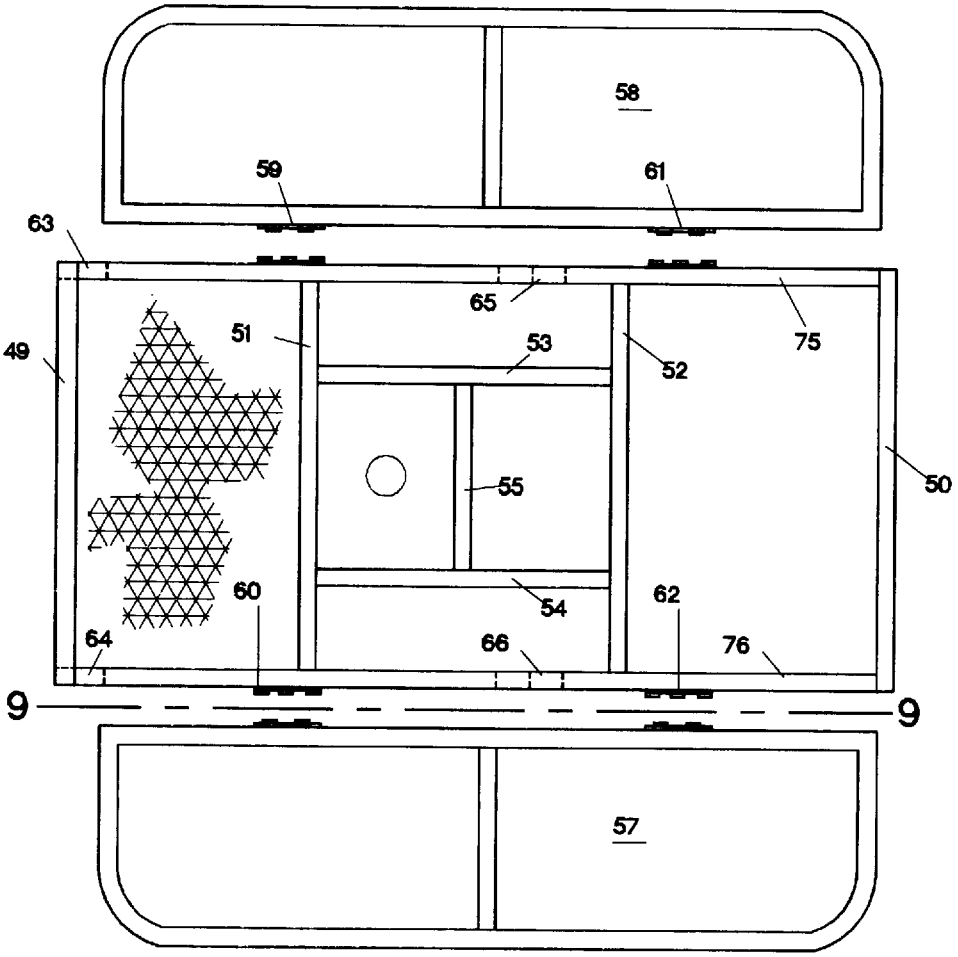
FIG. 8 is an exploded plan view of the central section of the platform and first and second extensions sections.

Referring now particularly to FIG. 8 of the drawings, the platform 4 is preferably constructed of 1×1 inch steel tubing. This platform is shown to comprise parallel bars 47 and 48 affixed to frame members 49 and 50,Parallel bars 51 and 52 affixed to and perpendicular to the parallel bars 75 and 76 provide additional rigidity to the platform. The platform is further reinforced by parallel bars 53 and 54 affixed to and perpendicular to the parallel bars 51 and 52. The bar 55 is fixed to and perpendicular to the parallel bars 53 and 54 and further support the pedestal of a chair.

Right angle brackets 63 and 64 are welded to the lower surfaces of parallel bars 75 and 76 and serve to support platform 4 on the ladder. Right angle braces 65 and 66 are welded to the lower surfaces of parallel bars 75 and 76 and support the platform brace members for rotation.

Platform 4 comprises an oblong central section described above (the width of which is less than the distance between the legs 27 and 28 of the ladder) and a pair of extension sections 57 and 58. The first extension 57 and the second extension 58 are designed to fold about hinges 59, 60, 61 and 62 into a closed position overlying the oblong central section or to an open position wherein the oblong central section and the first and second extension sections are essentially coplaner.

Figure 11:
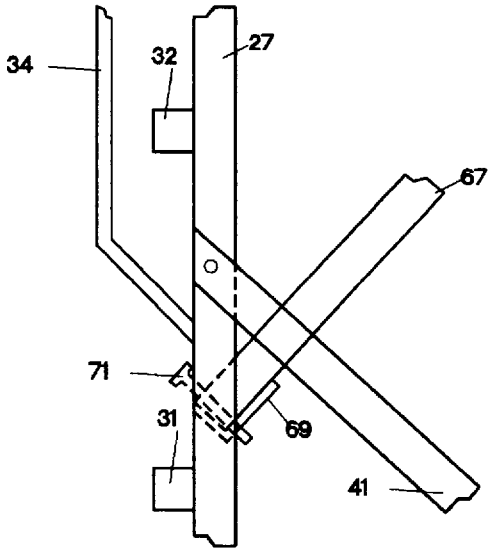
FIG. 11 is an enlarged broken side elevation along the line 11—11 of FIG. 5 illustrating one method of securing the the lower end of the platform support to the ladder.
Figure 13:
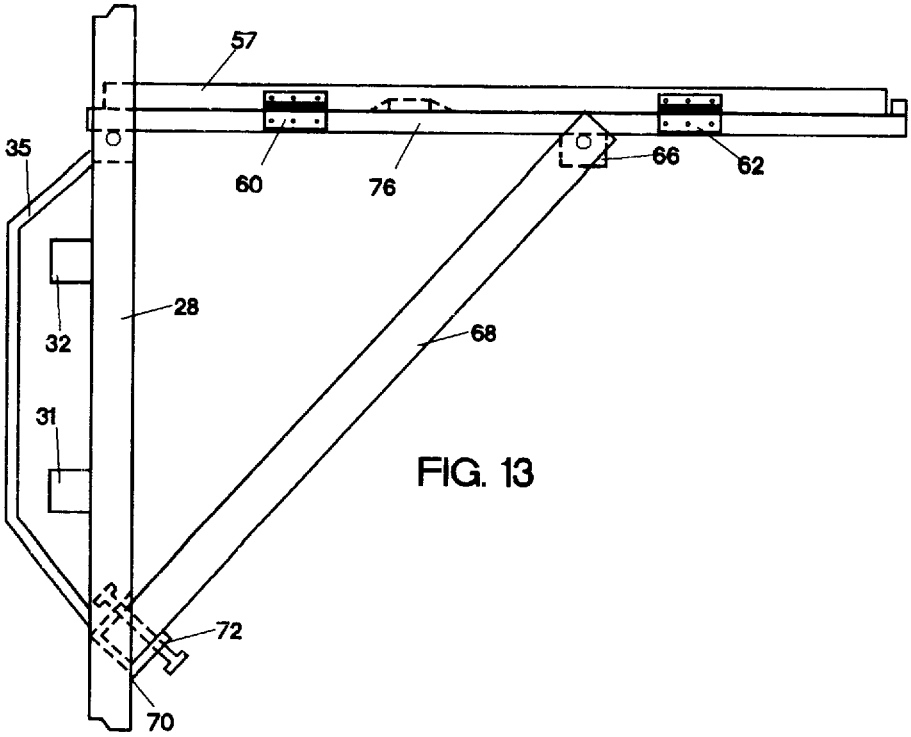
FIG. 13 is a broken enlarged side elevation of the platform and the platform brace, showing the central section of the platform and the second extension section of the platform rotated 180 degrees to a closed position on top of the central section.

As best shown in FIG. 5, FIG. 11 and FIG. 13, platform 4 is supported on the ladder by brace members 67 and 68. The upper end of brace members 67 and 68 are supported for rotation on brackets 65 and 66 by ⅜ inch stainless steel bolts held in place with lock nuts. The lower end of brace members 67 and 68 are received by two brackets 69 and 70 welded to the inside of the ladder legs 27 and 28 and secured in that position by the two release pins 71 and 72.

The platform 4 and both extension sections is covered with expanded metal as shown in FIG. 8 and supports a chair 73 which may pivot on it's pedestal to provide a view in all directions.

In accordance with the structure of the present invention described above, the hunter's stand described above may be quickly and easily installed upon a pick up truck by placing the stand assembly on the truck with the legs 17 and 18 of the base 1 behind the cab and the rear legs 19 and 20 in front of the tail gate. The feet 21, 22, 23 and 24 are bolted to the bed of the truck to secure the stand in position. The truck may then be driven to the desired hunting or other site.

To erect the hunter's stand to the position shown in FIG. 5 from the position shown in FIG. 3, the ladder brace 40 is rotated (in the direction of the arrow FIG. 7) to the rear of the truck and parallel to the ladder. The ladder is then rotated to the upright position (in the direction of the arrow FIG. 7) and is secured in this position by placing the lower ends of ladder brace 41 and 42 in the brackets 44 and 45 and inserting quick release pins 46 and 47.

To position the platform 4, the platform and chair are rotated on the ⅜ inch bolts securing the lower end of the platform to the ladder into a position parallel with the bed of the truck. The lower ends of platform brace members 67 and 68 are then placed in the brackets 69 and 70 and are secured to the ladder by the quick release pins 71 and 72 (see FIG.11 and FIG. 13). First and second extension sections are then rotated on hinges 59, 60, 61 and 62 into their coplaner position with the central platform.

The hunter's stand may be quickly and easily erected without resort to any hand or other tools or equipment, thus providing great convenience in the field. When hunting or other activities are over, the erection procedure for the ladder and platform may be quickly and easily reversed with the folding of the first and second platform extensions, the platform and chair and the ladder. The first step involves moving the first and second platform extensions in the direction of the arrows in FIG. 5 on top of the central platform. Removal of the quick release pins 71 and 72 permit moving the platform up to remove the platform brace members 67 and 68 from the brackets 69 and 70. The platform, chair and platform brace are then moved downward against the ladder in the direction of the arrow in FIG. 5.

Figure 6:
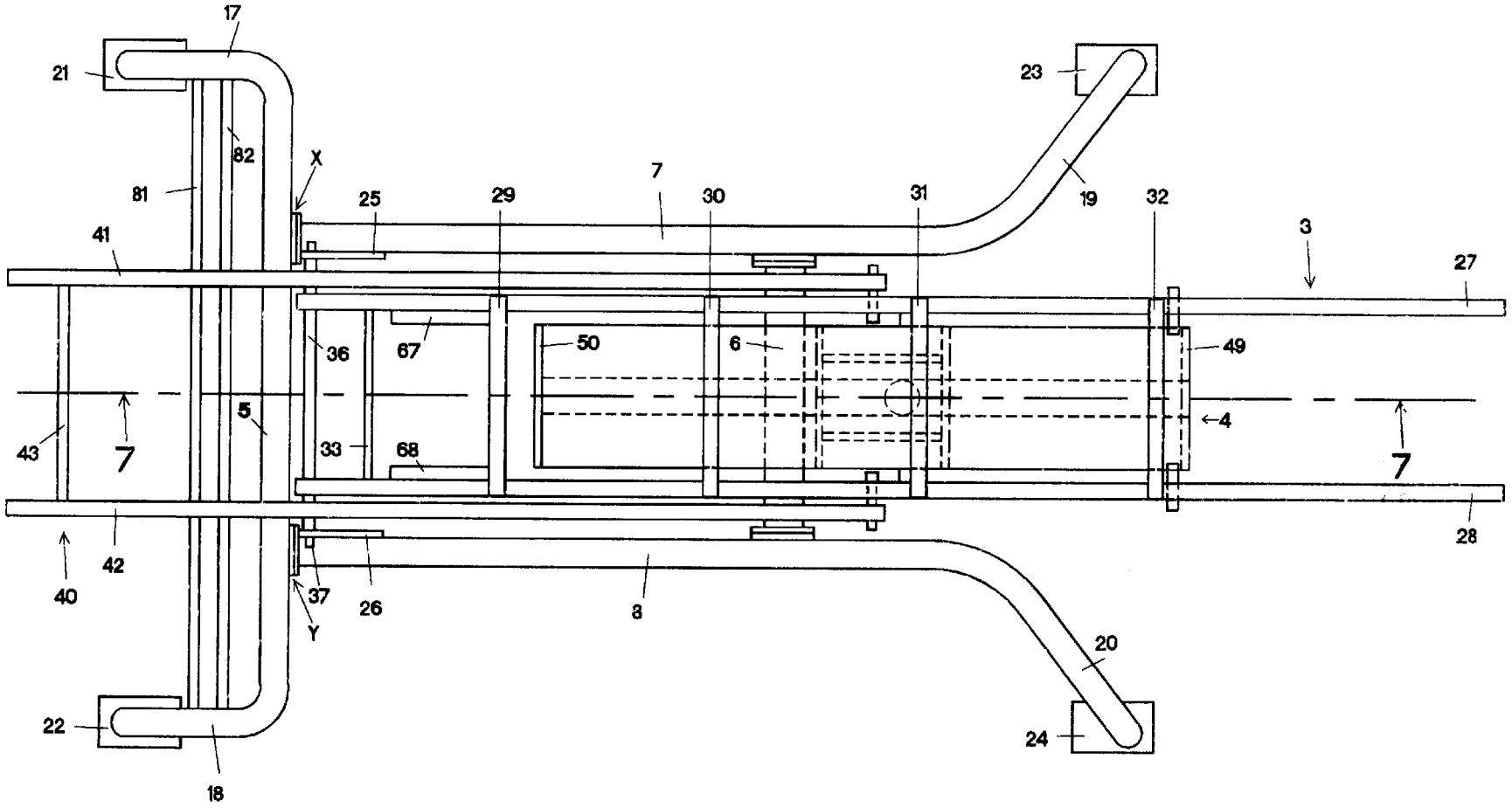
FIG. 6 is a plan view of the hunter's stand of FIG. 1 in the collapsed position.
Figure 7:
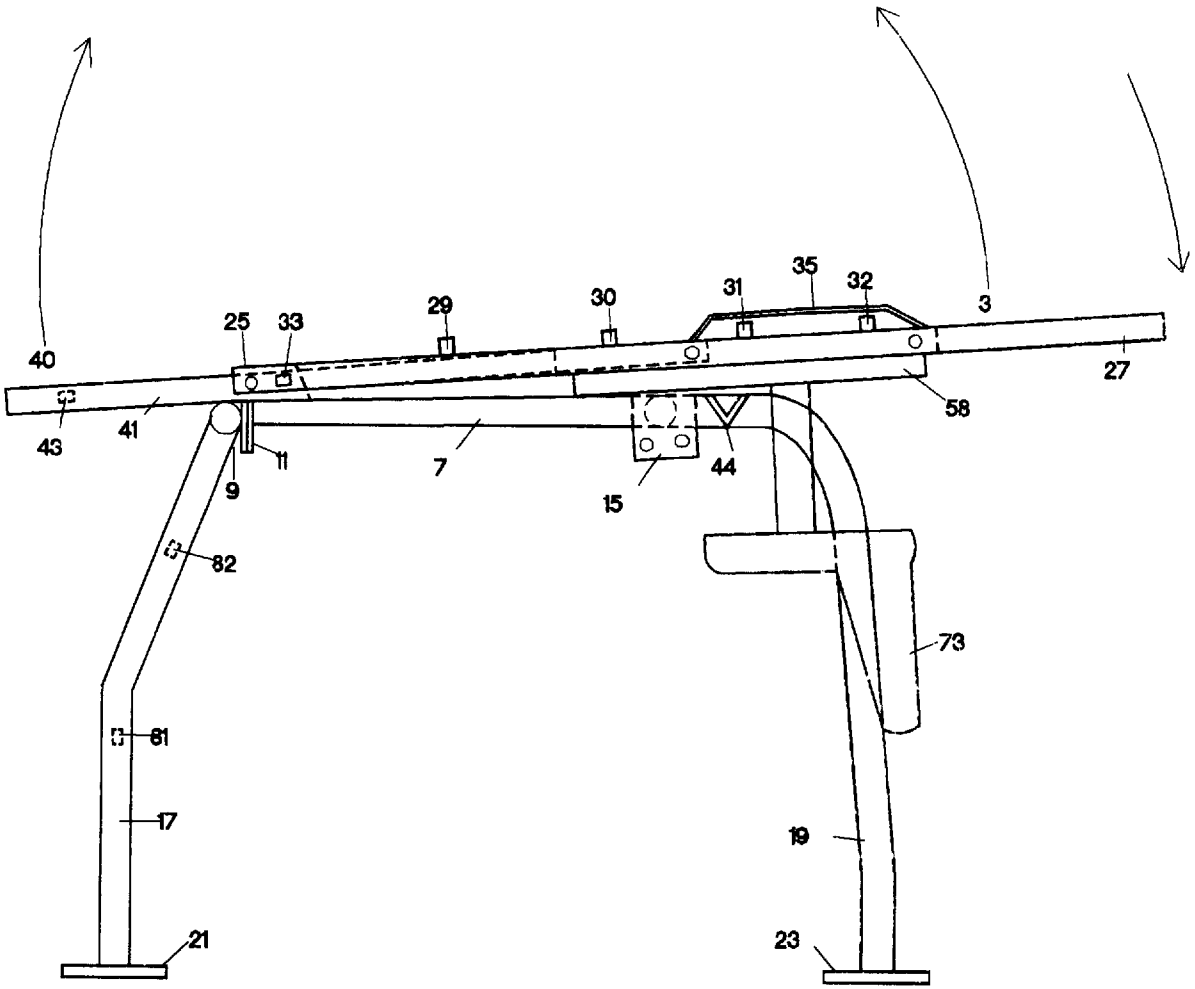
FIG. 7 is a side elevation of the hunter's stand along the line 7—7 of FIG. 6.
Figure 9:
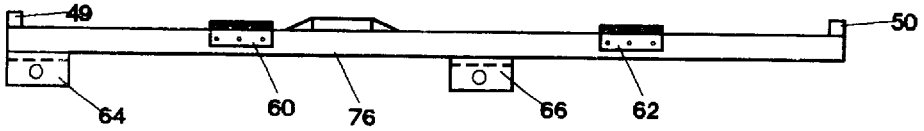
FIG. 9 is a side elevation of the central section of the platform along the line 8—8 of FIG. 8.

The next step is moving the ladder downwardly in the direction of the arrow in FIG. 5 to a position that is parallel with the bed of the truck. To accomplish this, the quick release pins 46 and 47 are removed from the brackets 43 and 44 permitting the ladder to be rotated forward and removal of the lower end of the ladder brace 40. The ladder brace and ladder are then rotated toward the rear of the truck while simultaneously holding the platform and chair against the under side of the ladder. When the ladder platform brace and platform are in their collapsed position supported by the rear member of the base 1, the ladder brace is rotated 90 degrees to it's forward position as shown in FIG. 6 and FIG. 7.

It is to be understood that the present invention is not limited to the sole embodiment described above, but encompasses any and all embodiments within the scope of the following claims.

What is claimed is:

1. A hunter's stand adapted to be temporarily mounted on and easily removed from a truck comprising:

(a) an oblong base having a front member a rear member and parallel side members, (b) two legs supporting said front member and two legs supporting said parallel side members, (c) bearing means positioned to receive and support an axle adjacent and parallel to said front member, (d) means providing for the temporary and secure attachment of said legs supporting said front member and said legs supporting said parallel side members to a truck, (e) a ladder the bottom end of which is mounted for rotation on an axle supported by said bearing means, (f) a platform mounted for rotation near the top of said ladder, (g) a platform brace mounted for rotation on said platform near the end of said platform that is remote from said ladder, (h) means on said ladder below said platform to receive and secure the distal ends of said platform brace, (i) a ladder brace one end of which is mounted for rotation on said ladder below said platform, (j) means on said parallel side members to receive and secure the other end of said ladder brace when said ladder is in the upright position, whereby;

the hunter's stand may be mounted on a truck, lowered below the top of said truck, transferred to a desired site, and erected by the hunter.

2. The hunter's stand of claim 1 wherein said ladder brace is mounted for rotation on said ladder section above the means to secure the distal end of said platform brace.

3. The hunter's stand of claim 1 wherein said platform comprises:

(a) an oblong central section, the width of which is less than the distance between legs of said ladder, (b) first and second extension sections, and (c) hinges supporting said first and second extension sections in their extended position on said central section, whereby;

said first and second extension sections may be rotated 180 degrees to a closed position on top of said central section.

4. The hunter's stand of claim 1 wherein said bearing means are two axle plates welded to said parallel side members at a junction of said parallel side members with said front member.

5. The hunter's stand of claim 4 having a tube traversing both legs of said ladder near the bottom thereof, said tube serving as a bearing surface for an axle extending through both of said axle plates.

6. The hunter's stand of claim 1 wherein said platform has a rotatable chair installed thereon.

7. The hunters stand of claim 1 wherein said oblong base is constructed of round 2 inch 16 gauge steel tube.

8. The hunters stand of claim 1 wherein said front member is fastened to said parallel side members by bolts.

9. The hunter's stand of claim 1 wherein said rear member is fastened to said parallel side members by bolts.

* * * * *